US006621463B1

(12) United States Patent
Lam

(10) Patent No.: US 6,621,463 B1
(45) Date of Patent: Sep. 16, 2003

(54) INTEGRATED FEED BROADBAND DUAL POLARIZED ANTENNA

(75) Inventor: Tommy H. Lam, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/192,724

(22) Filed: Jul. 11, 2002

(51) Int. Cl.[7] ..... H01Q 11/10
(52) U.S. Cl. ..... 343/792.5; 343/700 MS
(58) Field of Search ..... 343/700 MS, 789, 343/859, 792.5

(56) References Cited

U.S. PATENT DOCUMENTS

| | | | | | |
|---|---|---|---|---|---|
| 3,079,602 | A | | 2/1963 | Hamel et al. | 343/908 |
| 3,696,438 | A | | 10/1972 | Ingerson | 343/792.5 |
| 3,745,585 | A | | 7/1973 | Barbano | 343/792.5 |
| 3,824,595 | A | | 7/1974 | Hall | 343/113 R |
| 4,063,249 | A | | 12/1977 | Bergander et al. | 343/756 |
| 4,527,164 | A | | 7/1985 | Cestaro et al. | 343/713 |
| 4,594,595 | A | | 6/1986 | Struckman | 343/770 |
| 4,608,572 | A | | 8/1986 | Blakney et al. | 343/792.5 |
| 4,616,233 | A | | 10/1986 | Westerman | 343/792.5 |
| 4,652,889 | A | | 3/1987 | Bizouard et al. | 343/792.5 |
| 4,658,262 | A | | 4/1987 | DuHamel | 343/792.5 |
| 4,719,470 | A | | 1/1988 | Munson | 343/700 MS |
| 4,772,891 | A | | 9/1988 | Svy | 343/707 |
| 4,843,403 | A | | 6/1989 | Lalezari et al. | 343/767 |
| 4,903,033 | A | | 2/1990 | Tsao et al. | 343/700 MS |
| 5,053,786 | A | | 10/1991 | Silverman et al. | 343/895 |
| 5,093,670 | A | * | 3/1992 | Braathen | 343/792.5 |
| 5,164,738 | A | | 11/1992 | Walter et al. | 343/789 |
| 5,212,494 | A | | 5/1993 | Hofer et al. | 343/859 |
| 5,343,212 | A | | 8/1994 | Rose et al. | 342/424 |
| 5,453,751 | A | | 9/1995 | Tsukamoto et al. | 343/700 MS |
| 5,510,803 | A | | 4/1996 | Ishizaka et al. | 343/700 MS |
| 5,734,354 | A | | 3/1998 | Twelves | 343/815 |
| 5,777,583 | A | | 7/1998 | Canora et al. | 343/700 MS |
| 6,018,323 | A | * | 1/2000 | Van Hoozen et al. | 343/792.5 |
| 6,094,176 | A | * | 7/2000 | Van Hoozen et al. | 343/792.5 |
| 6,147,648 | A | | 11/2000 | Granholm et al. | 343/700 MS |
| 6,195,063 | B1 | | 2/2001 | Gabriel et al. | 343/797 |
| 6,211,839 | B1 | | 4/2001 | Campbell | 343/792.5 |
| 6,229,484 | B1 | | 5/2001 | Sagisaka | 343/700 MS |
| 6,317,084 | B1 | | 11/2001 | Chen et al. | 343/700 MS |

* cited by examiner

*Primary Examiner*—Don Wong
*Assistant Examiner*—Shih-Chao Chen
(74) *Attorney, Agent, or Firm*—McGuireWoods LLP

(57) ABSTRACT

An integrated feed broadband dual polarized antenna having a substantially planar support structure and a plurality of symmetrically positioned radiating structures disposed on the first surface of the planar support structure. A plurality of straight, non-interleaving ribs extend substantially perpendicularly from a first and second lengthwise side of each radiating structure. The plurality of straight, non-interleaving ribs extending from the first lengthwise side are complimentary to the plurality of straight, non-interleaving ribs extending from the second lengthwise side of the each radiating structure. Integrated microstrip lines serve as transmission lines to feed. The integrated microstrip lines form an integrated printed circuit infinite balun structure which is inherently frequency independent and provides 180° electrical phase required to feed a 180° rotated radiating structure.

20 Claims, 3 Drawing Sheets

INTEGRATED FEED BROADBAND DUAL POLARIZED ANTENNA

BACKGROUND OF THE INVENTION

1. Field of the Invention

The present invention generally relates to an antenna and, more particularly, to an integrated feed broadband dual polarized antenna.

2. Background Description

An antenna is a system of wires or other conductors used to transmit or receive radio frequency (RF) or other electromagnetic (EM) waves. An antenna may be formed of one or more lengths of electrical conductors which serve as "radiating elements", where each different length of the radiating element will resonate at a different frequency. Additional metal or dielectric elements may be added to the radiating elements in order to modify its electrical characteristics.

Antennas and antenna arrays have a wide array of applications. One such application may be in Electronic Support Measure (ESM) systems. In ESM systems, the antennas and other electronics are used to detect emittter signals and estimate several different parameters to provide situational awareness in an electronic warfare environment. These parameters may include, for example, (i) signals characteristics such as RF frequency, pulse width, pulse repetition interval and the like and (ii) incident wave information such as angle of arrival (AOA) (i.e., information concerning the angular direction of a signal source) and polarization for which estimation performance falls into the antenna subsystem design.

ESM systems, however, are polarization sensitive. By way of example, antennas that are circularly polarized can only detect the same sense of circularly polarized emitter signals or any linearly polarized emitter signals. Thus, if emitter signals are opposite sense to these antennas, the system will have poor signal strength and will result in incorrect AOA information. Also, although circularly polarized (CP) antennas can detect any linearly polarized emitters, the axial ratio of the given antenna becomes the key performance factor for AOA accuracy. This is because even a CP antenna responds differently to different linearly polarized signals which, in turn, depends on its circularity or its axial ratio. As a result, AOA accuracy can be compromised due to single calibration used to cover a broad range of linearly polarized emitters, e.g., vertical, horizontal, slant 45°, etc.

Thus, it is known that current CP antennas provide only one polarization state such as, for example, left hand circular (LHCP) or right hand circular (RHCP) polarization. By way of more specific explanation, a right-hand circularly polarized antenna will detect linearly polarized or right-hand elliptical or circular polarized radiation, but will not detect electromagnetic radiation of the left-hand polarization sense. Therefore, a system equipped with conventional single-sense antennas, such as broadband spiral antennas, will be unable to detect electromagnetic radiation of the opposite polarization sense (i.e., both LHCP and RHCP are not available for system processing), and would thus be "blind" to some threats.

A dual polarized antenna is thus needed to:

1. Cover a broader range of emitter polarizations;
2. Estimate emitter polarization and thereby obtain better emitter identification; and 3. Improve AOA accuracy through calibration over two orthogonal polarizations which are sufficient to span all polarization states.

To attempt to overcome some of the problems of known antennas, several different designs have been presented. For example, dual polarized microstrip elements have been known for years, but these systems have a very narrow band and are not applicable in ESM systems. Also, qual-ridged horns are known which are based on dual probe feeds inside waveguide structures. These designs provide dual polarization functions, but are bulky and costly because both the element and feed are not linear and cannot be manufactured with low cost printed circuit technology. Another known system is sinuous antennas (see, for example, U.S. Pat. No. 4,658,262) which have a planar design manufactured with printed circuit processing. This type of system, however, requires complex f&ed network or multiple baluns that run along the perpendicular axis. These feed networks and baluns are not easily realized with printed circuit technology which, in turn, increases the costs. These types of systems additionally are prone to vibration breakdown, which is not very advantageous in aviation applications.

To further attempt to solve the problems of known antenna systems, for example, U.S. Pat. Nos. 6,211,839 and 5,164,738, both include a planar structure. However, in both of these systems, the radiating arms are interleaved which provide poor polarization purity. Thus, when one radiating arm is excited, an adjacent, interleaved radiating arm will also become excited due to leakage. This contributes to cross polarization. These systems further include, in embodiments, curved surfaces as well as curved radiating arms, both of which provide for polarization wobbles along the curved arms thereby making calibrations unstable over operating frequency range.

SUMMARY OF THE INVENTION

In a first aspect of the present invention, an integrated feed broadband dual polarized antenna is provided. The antenna includes a substantially planar support structure having a first surface and a second surface. A plurality of symmetrically positioned radiating structures are disposed on the first surface of the planar support structure and a plurality of straight, non-interleaving ribs extend substantially perpendicularly from a first and second lengthwise side of each radiating structure. The plurality of straight, non-interleaving ribs extending from the first lengthwise side are complimentary to the plurality of straight, non-interleaving ribs extending from the second lengthwise side of the each radiating structure. Integrated microstrip lines serve as transmission lines to feed and are disposed on the second surface of the planar support surface and run along a length and are connected to two orthogonal, adjoining radiating structures of the plurality of symmetrically positioned radiating structures. The integrated microstrip lines form an integrated printed circuit infinite balun structure which is inherently frequency independent and provides 180° electrical phase required to feed a 180° rotated radiating structure.

In embodiments, the plurality of straight, non-interleaving ribs eliminates coupling or interference between respective, adjacent straight, non-interleaving ribs thereby providing pure polarization. Additionally, each of the plurality of straight, non-interleaving ribs have an angled connecting end to lengthen each of the straight, non-interleaving ribs. The length at resonance must be naturally quarter wave; however, the distance where the rib is located from the center point can control he H-plane beamwidth. The plurality of straight, non-interleaving ribs are also scalable and are isolated from ribs which extend from an adjacently positioned radiating structure. This eliminates interference between the non-interleaving ribs. The straight rib design provides a longest resonant length within a square aperture and thus maximizes available space for operating in a low frequency range. Additionally, the average cross coupling between the ribs is on the order of approximately −25dB.

In another aspect of the present invention, the integrated feed broadband dual polarized antenna includes a substantially planar support structure and a plurality of symmetrically positioned structures radiating at 0°, 90°, 180° and 270° from a central point on the first surface of the planar support structure. A plurality of complimentary, non-interleaving ribs extend perpendicularly from a first and second lengthwise side of each radiating structure, and integrated microstrip lines form an integrated printed circuit infinite balun structure. The plurality of complimentary, non-interleaving ribs eliminates coupling or interference between respective, adjacent non-interleaving ribs.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION.

The present invention is directed to a broadband dual polarized linear antenna, preferably with a 10:1 bandwidth, having a planar structure. In general, the antenna of the present invention has two output ports for transmitting or receiving both vertical and horizontal polarization, simultaneously. Two orthogonal infinite baluns, as integrated feeds, are provided for dual polarization. The balun.structure in conjunction with the planar support structure supports high volume and low cost manufacturing and significantly reduces stress between the joining of the balun to radiator structure. The design of the present invention further includes straight, non-interleaved ribs which achieves polarization purity performance to better resolve emitter identification/classification as well as better evaluation performance (i.e., better behaved conical pattern for high altitude airborne requirements). This design further provides better angle of arrival (AOA) performance.

Figure 1:
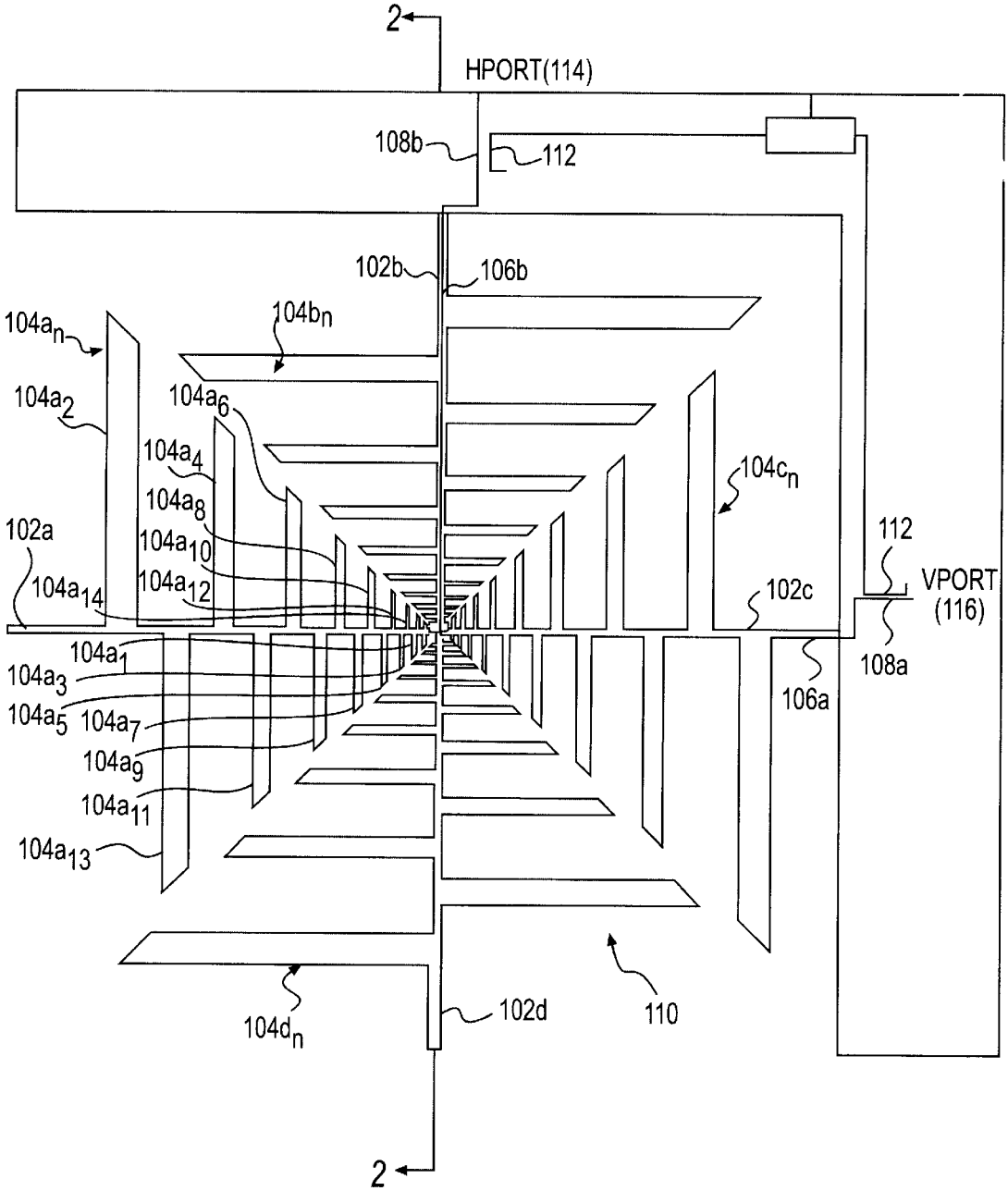
FIG. 1 is a schematic diagram of the polarized antenna of the present invention.

Referring now to FIG. 1, a schematic diagram of the antenna of the present invention is shown. The antenna is generally depicted as reference numeral 100 and includes four separate radiating structures 102*a*, 102*b*, 102*c* and 102*d* (also referred to hereinafter interchangeably as "arms"). In the preferred embodiment, each of the radiating structures 102*a*, 102*b*, 102*c* and 102*d* are identical, except each radiating structure is rotated by 90° with respect to an adjacent radiating structure. In more general terms, each radiating structure is respectively rotated 90°, 180° and 270° about a circle. For example, radiating structure 102*a* is rotated 90° from radiating structure 102*b* and 180° from radiating structure 102*c*. This design provides a rotationally symmetric pattern so that a conical cut pattern off the principal plane is still symmetrical for better AOA performance.

It should thus now be recognized that one pair of radiating structures 102*b* and 102*d* forms an equivalent of a two element array in the H plane. Similarly, one pair of radiating structures 102*a* and 102*c* forms an equivalent of a two element array in the E plane. Thus, there is a rotational symmetry which, in turn, assures elevational performance to thereby accurately be able to compare off elevation plane signatures (directional finding). If the antenna does not have rotational symmetry, it is difficult to have a well behaved antenna on that plane to perform directional finding.

As further seen in FIG. 1, central point "A" is provided between the radiating structures 102*a*, 102*b*, 102*c* and 102*d*. With point "A" as a reference, each of the radiating structures 102*a*, 102*b*, 102*c* and 102*d* have a line width narrower at the center, proximate to point "A", and wider at the opposing, connector ends. In a preferred embodiment, the narrower section is approximately about 0.006 inches and the wider, opposing end is approximately about 0.024 inches. This configuration provides high impedance to low impedance transformation for efficiently matching the radiating structures to a 50 ohm connector. The narrow line width also allows for the radiating structure width near point "A" to be small thereby avoiding parasitic effects in high frequency radiation.

Still referring to FIG. 1, a plurality of straight, non-interleaving ribs $\mathbf{104}a_n$, $\mathbf{104}b_n$, $\mathbf{104}c_n$ and $\mathbf{104}d_n$ extend substantially perpendicularly from each lengthwise side of the respective radiating structures 102*a*, 102*b*, 102*c* and 102*d*. In one embodiment, seven ribs extend orthogonal from opposing sides of each of the radiating structures in an alternating or complimentary manner. (It is well known in the art that efficiency degrades with more ribs dues to $I^2R$ loss.) For example, ribs $\mathbf{104}a_1$, $\mathbf{104}a_3$, $\mathbf{104}a_5$, $\mathbf{104}a_7$, $\mathbf{104}a_9$, $\mathbf{104}a_{11}$, $\mathbf{104}a_{13}$extend orthogonal from a first side of the radiating structure and ribs $\mathbf{104}a_2$, $\mathbf{104}a_4$, $\mathbf{104}a_6$, $\mathbf{104}a_8$, $\mathbf{104}a_{10}$, $\mathbf{104}al_{12}$, $\mathbf{104}a_{14}$ extend orthogonal from the other side of the radiating structure 102*a* (complimentary to the opposing ribs). The plurality of ribs $\mathbf{104}a_n$, $\mathbf{104}b_n$, $\mathbf{104}c_n$ and $\mathbf{104}d_n$ are scalable (i.e., smaller ribs towards point"A") in order to maintain frequency independent performance properties. That is, by way of illustration, rib $\mathbf{104}a_2$ is larger than ribs $\mathbf{104}a_4$, $\mathbf{104}a_6$, $\mathbf{104}a_8$, $\mathbf{104}a_{10}$, $\mathbf{104}a_{12}$, $\mathbf{104}a_{14}$. The desired operating frequency is dependent on the lengths of the largest and smallest ribs, which is usually dictated by design specifications.

Additionally, each adjacent set of ribs $\mathbf{104}a_n$, $\mathbf{104}b_n$, $\mathbf{104}c_n$ and $\mathbf{104}d_n$, in embodiments, has a 45° end, but may equally have a 30° or other angled end, depending on the desired length of the ribs. The desired length of the ribs $\mathbf{104}b_n$ and $\mathbf{104}d_n$ will control the beamwidth on the H plane. Thus, for example, at a given frequency, the 45° rib may resonate; whereas the 30° rib will not resonate at the given frequency. The adjacent set of ribs $\mathbf{104}a_n$, $\mathbf{104}b_n$, $\mathbf{104}c_n$ and $\mathbf{104}d_n$ are also designed such that they will not overlap with one another (are isolated) and will not be in the same plane. For example, the ribs $\mathbf{104}a_n$ are in the E plane while the adjacent set of ribs $\mathbf{104}b_n$ and $\mathbf{104}d_n$ are in the H plane, with no overlap or interleave. This ensures that there is no coupling or interference between respective, adjacent set of ribs; that is, there will be no leakage when one set of ribs becomes excited. This limits signal degradation and provides for pure polarization.

As to the rib design and configuration, computer modeling has shown that such a design reduces the cross polarization between each, adjacent radiating structures. By way of explanation, computer modeling results show cross coupling on the order of −13dB or more exists in an interleaved, curve rib structure which is highly undesirable. That is, if excessive cross coupling exists on one pair of interleaved ribs, the cross pair can introduce significant leakage to the co-polarized pair when rotated 90°. This leakage will, in turn, corrupt the elementary dipole pattern quality and will degrade AOA performance. The rib design of the present invention, however, has cross coupling on the order of approximately −25dB or less, which is acceptable. The straight rib design further provides the longest resonant length within the square aperture. This, in effect, maximizes the available space and gives the smallest antenna size for operating in the lowest frequency range.

The plurality of ribs 104$a_n$, 104$b_n$, 104$c_n$ and 104$d_n$ further carry the resonant or standing wave currents which are in phase in the active region when the plurality of ribs 104$a_n$, 104$b_n$, 104$c_n$, and 104$d_n$, are approximately quarter wavelength long. The active region, in embodiments, is the region where the current on the structure efficiently radiates into space. The antenna size may be limited to the rib length being quarter wavelength long at the lowest operating frequency. At this wavelength, the standing wave current becomes dominant with respect to all other length rib currents and the desired radiation pattern in the E plane similar to elementary dipole radiator results.

The design of the present invention also provides an array factor with similar pattern roll off in the H plane. As a result, with proper rib to arm length ratio, it is possible to provide equal E and H plane beamwidths or patterns. (FIGS. 3*a*–3*d*) In the preferred embodiments, a 1:1 ratio is desirable such that the dipole plane, which is the E plane, equals the H plane array factor. This is an important feature because when two pairs of arms co-exist on the same aperture with 90° rotation, the E plane of one pair is the H plane of the other pair. (Without equal E and H plane beamwidth feature, poor circular polarization over wide angles and poor elevation performance will result.)

FIG. 1 additionally shows two microstrip lines 106*a* and 106*b* serving as microwave transmission lines to feed. In embodiments, the microstrip lines 106*a* and 106*b* run along the length on the bottom side of a substrate board 110, such as a microwave substrate material (insulator), and correspond to the radiating structures 102*c* and 102*d*, respectively. Alternatively, the microstrip lines 106*a* and 106*b* may run along the lengths of the radiating structures 102*a* and 102*d* or any combination of orthogonal, adjoining radiating structures. The microstrip lines 106*a* and 106*b* may use the width of the respective radiating structures as their ground planes to guide the RF energy from the antenna to the RF coaxial connectors 108*a* and 108*b*, respectively, or integrated RF electronics printed on the substrate board 110. This feeding method basically forms an integrated printed circuit infinite balun structure which is inherently frequency independent and provides 180° electrical phase required to feed the 180° rotated radiating structure. Structural symmetry is also preserved.

One microstrip line, for example, microstrip line 106*a*, may be electrically connected to the radiating structure 102*c* at the center point "A" through via hole (FIG. 2) which does not require any soldering operation. On the other hand, a small electrical wire may be required to connect the microstrip line 106*b* to the radiating structure 102*b* through a predrilled hole. This latter wire should be fully supported by the substrate board 110, with no vibration problem anticipated (unlike the center fed sinuous design);

The design of the present invention further includes integrated built in test capability. A standard interdigital Lange coupler design 112 or other printed circuit coupler technology can be incorporated as part of the antenna assembly. Also, an H port 114 and a V port 116 are also provided. Because of the planar structure, multiple elements can be printed on the same circuit board to form an interferometer array. This can dramatically reduce system weight and interconnect cables and their undesired loss characteristics. Also, this design of the present invention can be extended into conformal elements which significantly increases the installation flexibility where platform space is a prime concern.

The present design is based on frequency independent log periodic principle well known in the art. In general, the spacing of the ribs is determined from the relationship for log-periodic antennas $R(n+1)=\tau R(n)$, where $\tau<1$ and $R(n)$ denotes the outer radius of element (branch) n. The design of the present invention is also based on a square aperture for supporting the straight, non-interleaving, log periodic geometry for polarization purity, isolation and symmetric pattern. The isolation and symmetric pattern is based on design techniques which equalize current element beamwidth in the E plane and array element beamwidth in the H plane. This achieves (i) polarization purity performance to better resolve emitter identification/classification, (ii) better evaluate performance (i.e., better behaved conical pattern for high altitude airborne requirements) and (iii) better angle of arrival (AOA) performance. It should now also be well understood by those of ordinary skill in the art that the design of the present invention can provide LHCP and RHCP, dual CP function due to the four respective radiating structures 102*a*, 102*b*, 102*c* and 102*d* with each pair fed in quadrature phase.

Figure 2:
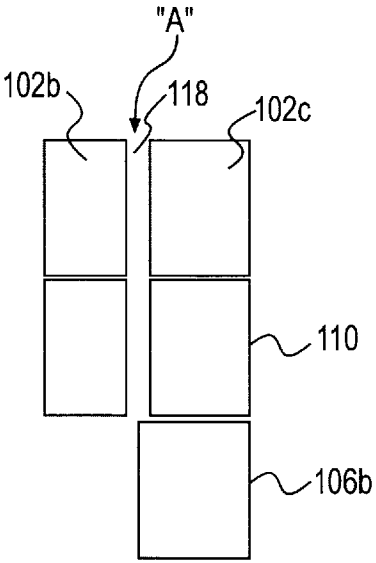
FIG. 2 shows a cross section of FIG. 1 along line 2—2.

FIG. 2 is a cross sectional view of FIG. 1 along line 2—2. In this view, a via hole 118 is shown which allows connection between the radiating structure 102*c* with microstrip 108*a*, for example. This allows a connection without any soldering. FIG. 2 further shows the radiating structure 102*c* being separated from the microstrip 106*a* via the substrate board 110. Similarly, although not shown in this figure, the radiating structure 102*b* may be separated from the microstrip 106*b* via the substrate board 110.

Figure 3A:
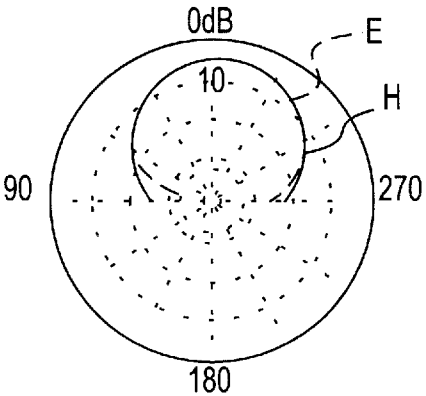
FIGS. 3*a* through 3*d* show measured performances over a range of frequencies.
Figure 3B:
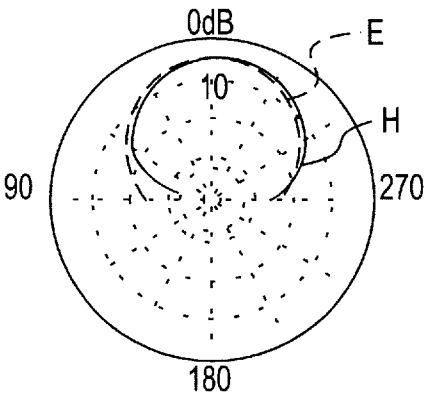
Figure 3C:
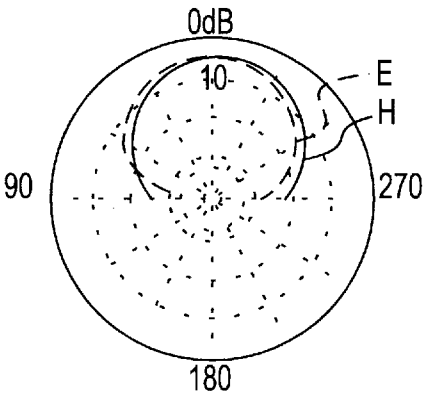
Figure 3D:
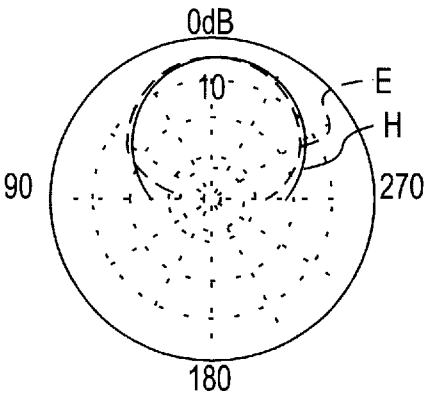

FIGS. 3*a* through 3*d* show measured performances over a range of frequencies using the antenna of the present invention. More specifically, FIGS. 3*a*–3*d* show the quality of the amplitude response at different angles and at difference frequency ranges. Specifically, FIG. 3*a* shows a measured performance in the E and H plane cut at 1 GHz. FIG. 3*b* shows a measured performance in the E and H plane cut at 2 GHz. FIG. 3*c* shows a measured performance in the E and H plane cut at 3 GHz, and FIG. 3*b* shows a measured performance in the E and H plane cut at 4 GHz. As seen in FIGS. 3*a*–3*d*, the beamwidth in each plane, i.e., the E and H plane, is substantially the same at different antenna rotation angles.

Figure 4:
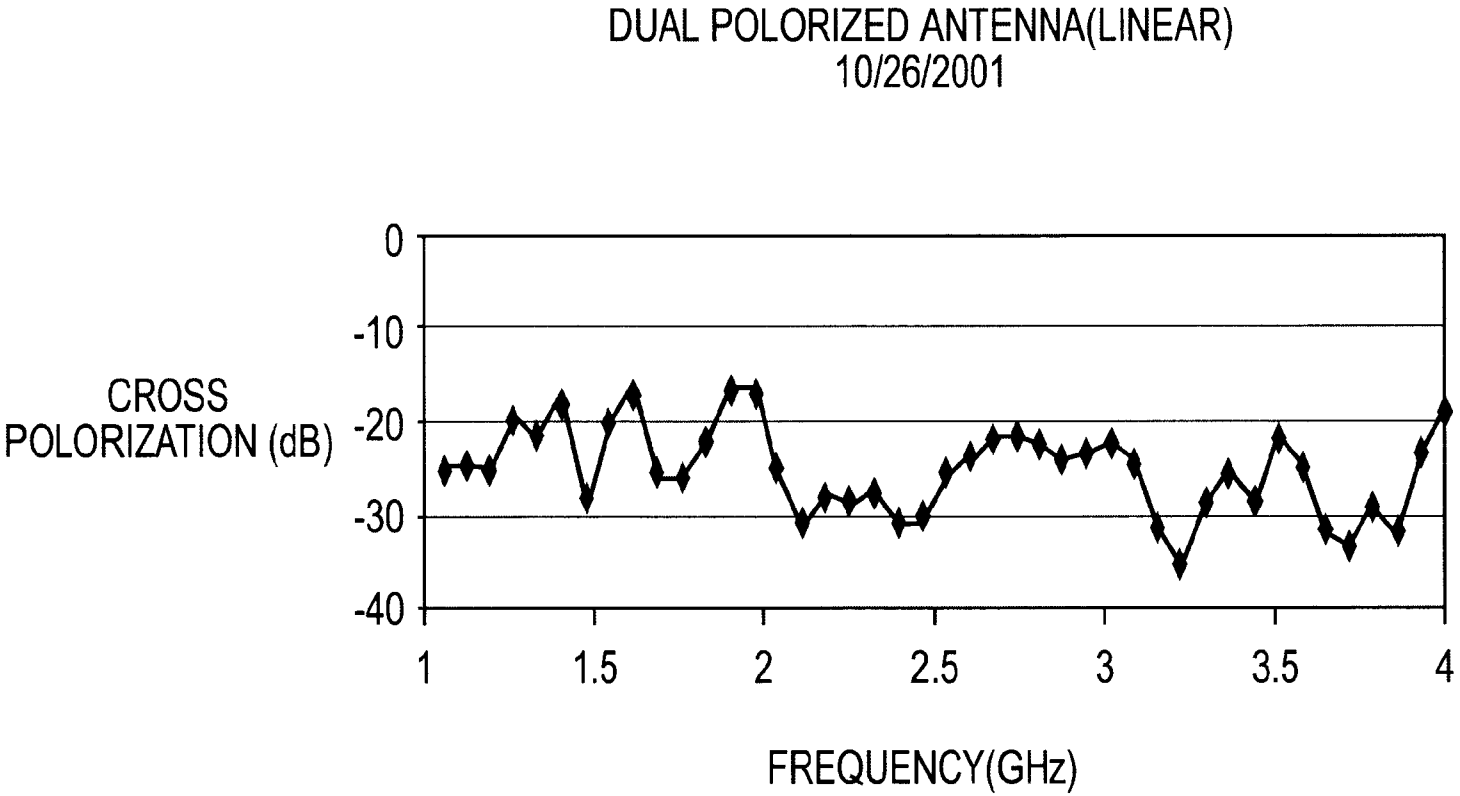
FIG. 4 shows a graph of frequency versus cross polarization.

FIG. 4 shows a graph of frequency versus cross polarization. Specifically, FIG. 4 shows the coupling between the radiating structures 102*b*, 102*d* and 102*a*, 102*c*. The average cross coupling of the present invention is of the order of approximately −25dB. This is due to the unique configuration of the present invention. However, prior art sinuous antennas typically have a cross coupling of −13dB While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. An integrated feed broadband dual polarized antenna, comprising:

a substantially planar support structure having a first surface and a second surface;

a plurality of symmetrically positioned radiating structures disposed on the first surface of the planar support structure;

a plurality of straight, non-interleaving ribs extending substantially perpendicularly from a first and second lengthwise side of each radiating structure of the plurality of symmetrically positioned radiating structures, the plurality of straight, non-interleaving ribs extending from the first lengthwise side being complimentary to the plurality of straight, non-interleaving ribs extending from the second lengthwise side of the each radiating structure; and integrated microstrip lines serving as transmission lines to feed being disposed on the second surface of the substantially planar support surface and running along a length and being connected to two orthogonal, adjoining radiating structures of the plurality of symmetrically positioned radiating structures, wherein the integrated microstrip lines form an integrated printed circuit infinite balun structure which is inherently frequency independent and provides 180° electrical phase required to feed a 180° rotated radiating structure.

2. The antenna of claim 1, wherein the plurality of straight, non-interleaving ribs eliminates coupling or interference between respective, adjacent straight, non-interleaving ribs thereby providing pure polarization.

3. The antenna of claim 1, wherein each of the plurality of straight, non-interleaving ribs have an angled connecting end to lengthen each of the plurality of straight, non-interleaving ribs.

4. The antenna of claim 3, wherein the length of the straight, non-interleaving ribs control a beamwidth on the H plane.

5. The antenna of claim 1, wherein the plurality of straight, non-interleaving ribs are seven ribs extending orthogonal from each of the first and second lengthwise sides of each of the radiating structures.

6. The antenna of claim 1, wherein the plurality of straight, non-interleaving ribs extending substantially perpendicularly from the first lengthwise side are isolated from a plurality of straight, non-interleaving ribs extending substantially perpendicularly from the second lengthwise side of an adjacently positioned radiating structure, thereby eliminating interference between the plurality of straight, non-interleaving ribs.

7. The antenna of claim 1, wherein the plurality of straight, non-interleaving ribs are scalable in order to maintain frequency independent performance properties.

8. The antenna of claim 1, wherein the plurality of symmetrically positioned radiating structures are four radiating structures, each positioned about 90° about a circle to provide rotationally symmetry.

9. The antenna of claim 1, wherein a first pair of radiating structures forms an equivalent of a two element array in an H plane and a second pair of the radiating structures forms an equivalent of a two element array in an E plane.

10. The antenna of claim 1, wherein:

the plurality of symmetrically positioned radiating structures cross over a central point "A", each of the plurality of symmetrically positioned radiating structures have a line width which is narrower at the central point "A" and gradually becomes wider at a connecting end such that the narrower width avoids parasitic effects in high frequency radiation, the plurality of straight, non-interleaving ribs are scalable such that a shortest straight, non-interleaving rib is positioned closet to the central point "A" on each of the plurality of symmetrically positioned radiating structures, and one of the microstrips is connected to one of the two orthogonal, adjoining radiating structures via a hole at the central point "A".

11. The antenna of claim 10, wherein the narrower width is approximately 0.006 inches and the wider width is approximately 0.024 inches to provide high impedance to low impedance transformation for matching each of the plurality of symmetrically positioned radiating structures to a 50 ohm connector.

12. The antenna of claim 1, wherein the straight rib design provides a longest resonant length within a square aperture to maximize available space for operating in a low frequency range.

13. The antenna of claim 1, wherein a rib to radiating structure length ratio is 1:1 ratio such that a dipole plane equals an H plane array factor.

14. The antenna of claim 1, wherein the microstrip lines use a width of the radiating structures as ground planes to guide RF energy from the antenna to RF coaxial connectors.

15. The antenna of claim 1, wherein average cross coupling between the plurality of straight, non-interleaving ribs is of the order of approximately −25dB or less.

16. An integrated feed broadband dual polarized antenna, comprising:

a substantially planar support structure having a first surface and a second surface;

a plurality of symmetrically positioned structures radiating at 0°, 90°, 180° and 270° from a central point on the first surface of the planar support structure;

a plurality of complimentary, non-interleaving ribs extending perpendicularly from a first and second lengthwise side of each radiating structure of the plurality of symmetrically positioned radiating structures; and integrated microstrip lines forming an integrated printed circuit infinite balun structure disposed on the second surface of the substantially planar support surface and connecting to two orthogonal, adjoining radiating structures of the plurality of symmetrically positioned radiating structures, wherein the plurality of complimentary, non-interleaving ribs eliminates coupling or interference between respective, adjacent straight, non-interleaving ribs.

17. The antenna of claim 16, wherein:

each of the plurality of complimentary, non-interleaving ribs have an angled connecting end to lengthen each of the plurality of complimentary, non-interleaving ribs, the length of the complimentary, non-interleaving ribs control a beamwidth on the H plane, and the complimentary, non-interleaving ribs are scalable in order to maintain frequency independent performance properties.

18. The antenna of claim 16, wherein the plurality of complimentary, non-interleaving ribs extending from the first lengthwise side are isolated from a plurality of complimentary, non-interleaving ribs extending from the second lengthwise side of an adjacently positioned radiating structure.

19. The antenna of claim 16, wherein a first pair of radiating structures forms an equivalent of a two element array in an H plane and a second pair of the radiating structures forms an equivalent of a two element-array in an E plane in a square aperture.

20. The antenna of claim 16, wherein:

the plurality of symmetrically positioned radiating structures cross over the central point, each of the plurality of symmetrically positioned radiating structures have a line width which is narrower at the central point and gradually becomes wider at a connecting end such that the narrower width avoids parasitic effects in high frequency radiation, the plurality of complimentary, non-interleaving ribs are scalable such that a shortest straight, non-interleaving rib is positioned closet to the central point on each of the plurality of symmetrically positioned radiating structures, and one of the microstrips is connected to one of the two orthogonal, adjoining radiating structures via a hole at the central point.

* * * * *